US007070386B2

(12) United States Patent
Kessler et al.

(10) Patent No.: US 7,070,386 B2
(45) Date of Patent: Jul. 4, 2006

(54) AIRFOIL INSERT WITH CASTELLATED END

(75) Inventors: Barry S. Kessler, Hampden, MA (US); Donald Evans, Mansfield Center, CT (US)

(73) Assignee: United Technologies Corporation, Hartford, CT (US)

( * ) Notice: Subject to any disclaimer, the term of this patent is extended or adjusted under 35 U.S.C. 154(b) by 97 days.

(21) Appl. No.: 10/877,395

(22) Filed: Jun. 25, 2004

(65) Prior Publication Data

US 2005/0286997 A1 Dec. 29, 2005

(51) Int. Cl.
*F03B 11/00* (2006.01)

(52) U.S. Cl. ..... 415/115; 416/96 A

(58) Field of Classification Search ..... 415/115, 415/116, 117; 416/96 R, 96 A, 97 R, 97 A
See application file for complete search history.

(56) References Cited

U.S. PATENT DOCUMENTS 3,858,290 A * 1/1975 Albani ..... 29/889.722
6,561,757 B1 * 5/2003 Burdgick et al. ..... 415/115

* cited by examiner

*Primary Examiner*—Edward K. Look
*Assistant Examiner*—Dwayne J White
(74) *Attorney, Agent, or Firm*—Colin L. Cini

(57) ABSTRACT

Provided is an airfoil insert for discharging an increased volume of cooling air. The insert comprises a perforated, tubular-shaped body with a first end for introducing the cooling air. A second end located opposite the first end and discharges an increased volume of the cooling air for use in cooling inboard components. The second end approximates a castellated wall and comprises one or more tabs spaced about the periphery. Alternating between tabs are notches in the body for discharging the cooling air. Covers may be joined to opposing tabs by bridging across the second end, or opposing tabs themselves may be joined together by bridging across the second end.

15 Claims, 4 Drawing Sheets

FIG.3
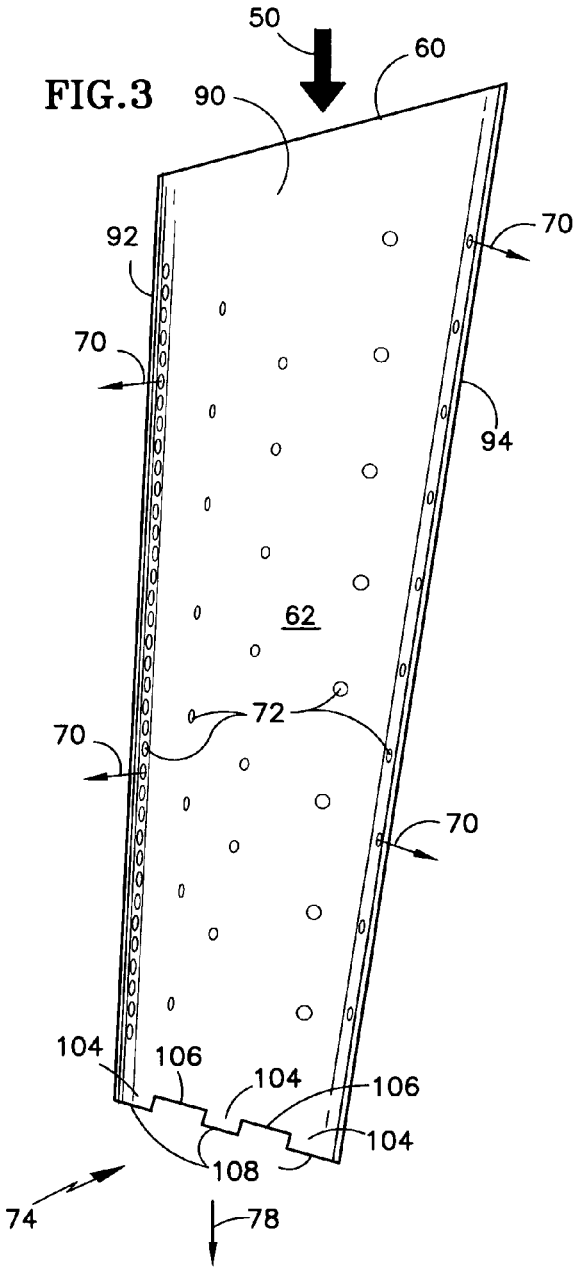
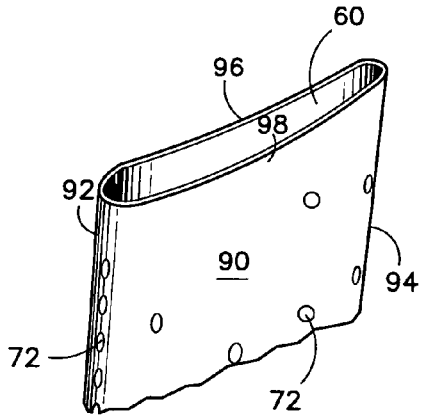
FIG.4

FIG.5
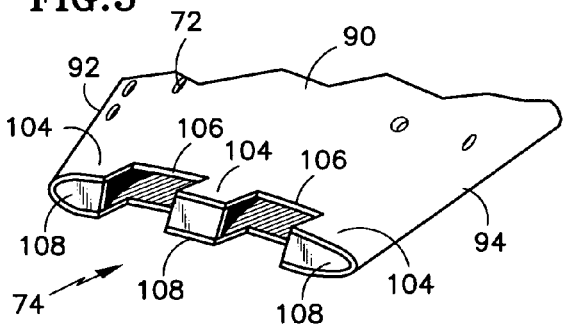
FIG.8
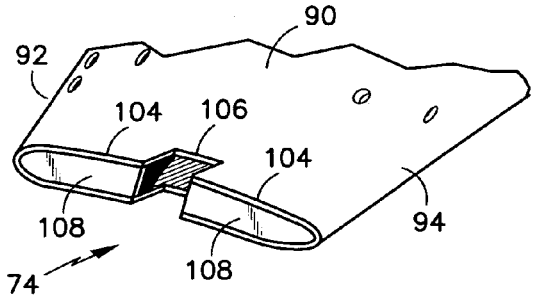
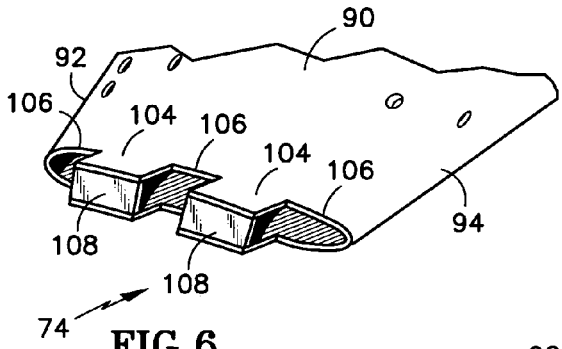
FIG.6
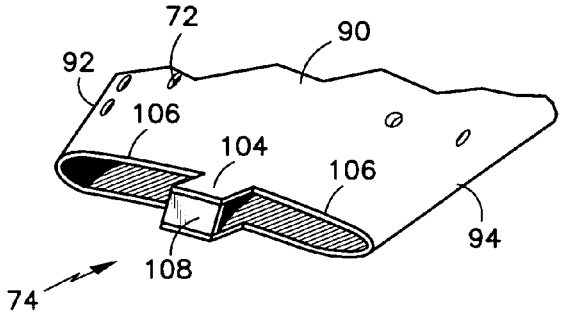
FIG.7

AIRFOIL INSERT WITH CASTELLATED END

BACKGROUND OF THE INVENTION (1) Field of the Invention

The invention relates to gas turbine engine components, and more particularly to an airfoil insert for discharging an increased volume of cooling air.

(2) Description of the Related Art

In a gas turbine engine, incoming air is pressurized by a compressor and mixed with fuel in a combustor. The fuel and air mixture is burned and expelled from the combustor as hot combustion gases. The hot combustion gases are directed to a turbine disposed downstream of the combustor, where the turbine extracts power from the gases and rotates the compressor via a common shaft.

The turbine is comprised of alternating axial stages of rotating blades and stationary vanes. The blades within each stage are circumferentially spaced about a disk attached to the common shaft, whereas the vanes are cantilevered inward from an outer casing structure. A spacer located radially inboard of the vanes, controls the axial spacing of successive bladed disks. A rotating seal, affixed to the spacer, discourages interstage leakage of the combustion gases by mating with a stationary land attached to the inner diameter of the vanes. The interstage seal and land are crucial to the operating efficiency and performance of the gas turbine engine.

Protecting turbine components from the hot combustion gases is very important, since the combustion gas temperature may exceed the melting temperature of the component's base material. For protection, these components are typically insulated with high-temperature coatings and convectively cooled with a portion of the compressor air. This portion of the compressor air bypasses the combustion process and is hereinafter referred to as cooling air.

Since the interstage seal and land are located radially inboard of the vanes, the cooling air must first be channeled through the vanes to reach them. Typically, a tubular insert is located inside each vane to apportion the cooling air between the vane and the interstage seal and land. The insert is open at a first end to allow cooling air to enter from an outboard annular plenum, and is perforated along its length to generate impingement-cooling jets within the vane. The second end of the insert is partially restricted by a perforated cover to increase the velocity of the impingement-cooling jets in the vane and to allow for a portion of the cooling air to discharge to the interstage seal and land. The cover also adds structural strength to the tubular insert, which may deform during assembly and from the extreme combustion gas temperatures.

As the cooling air passes through the vanes and other components, its temperature increases, diminishing its ability to cool the interstage seal and land. Since the longevity of the interstage seal and land is crucial to maintaining the overall efficiency and performance of the gas turbine engine, any improvement in durability is advantageous. If the operating temperature of the interstage seal and land is reduced, the durability is improved and the serviceable life is extended. Utilizing a lower temperature cooling air source, or providing a greater volume of available cooling air will reduce the operating temperature of the interstage seal and land. Since a lower temperature cooling air source does not have sufficient pressure to ensure constant flow, then the vane insert must distribute an increased volume of available cooling air to the interstage seal and land.

Reducing the level of restriction in the second end of the insert increases the volume of cooling air; however, simply adding additional perforations in the existing cover will weaken the cover and make it more susceptible to thermal fatigue cracks and oxidation. Introducing oblong holes in the existing cover is expensive and the remaining cover material is susceptible to cracking and oxidation. Removing the existing cover entirely reduces the velocity of the impingement-cooling jets in the vane and jeopardizes the structural integrity of the insert.

What is needed is an insert for distributing an increased volume of available cooling air to the interstage seal and land, without reducing the velocity of the impingement-cooling jets or diminishing the structural integrity of the insert. Additionally, the insert must be capable of being produced in a robust and repeatable manner, with existing manufacturing processes and tooling and at a reasonable cost.

BRIEF SUMMARY OF THE INVENTION

Provided is an airfoil insert for discharging an increased volume of cooling air to an interstage seal and land. The insert comprises a perforated, tubular-shaped body with a first end for introducing available cooling air. A second end approximates a castellated wall and comprises one or more tabs extending from the body and spaced about a second end periphery. Separate covers may be joined to the tabs by bridging across the second end, or opposing tabs may be joined together by bridging across the second end. The bridging of the second end creates a partial restriction, apportioning the available cooling air between the vane and the interstage seal and land. Alternating between the tabs are notches in the body, providing passages for discharging an increased volume of cooling air to the interstage seal and land.

The volume of cooling air discharged by the notches is greater than is discharged by a perforated cover, since the notches extend radially into the body of the insert. The tabs also act as ligaments and provide the structural support necessary to prevent the insert from deforming during assembly and under the extreme combustion gas temperatures. Other features and advantages will be apparent from the following more detailed descriptions, taken in conjunction with the accompanying drawings, which illustrate, by way of example, several exemplary embodiment inserts.

BRIEF DESCRIPTION OF THE SEVERAL VIEWS OF THE DRAWINGS

FIG. 3 is a partial sectional view of an embodiment of the inventive insert.

FIG. 4 is a partial perspective view of a first end of an embodiment of the inventive insert.

FIG. 5 is a partial perspective view of a second end of an embodiment of the inventive insert.

FIG. 6 is a partial perspective view of a second end of an alternate embodiment of the inventive insert.

FIG. 7 is a partial perspective view of a second end of yet another alternate embodiment of the inventive insert.

FIG. 8 is a partial perspective view of a second end of yet another alternate embodiment of the inventive insert.

When referring to the drawings, it is to be understood that like reference numerals designate identical or corresponding parts throughout the several views.

DETAILED DESCRIPTION OF THE INVENTION

Figure 1:
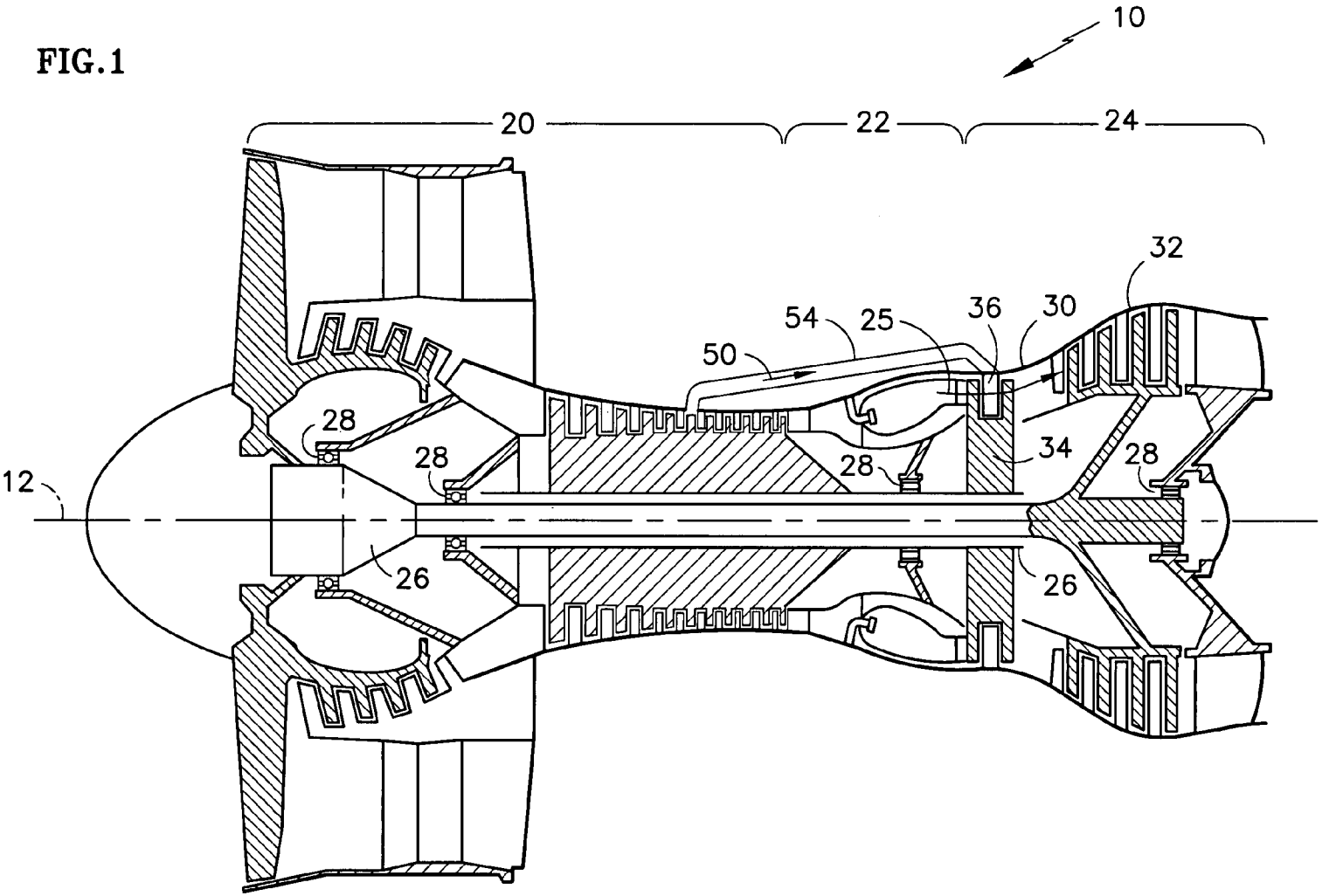
FIG. 1 is a simplified schematic sectional view of a gas turbine engine along a central, longitudinal axis.

Referring to FIG. 1, a gas turbine engine 10 with a central, longitudinal axis 12 contains one or more compressors 20, a combustor 22 and one or more turbines 24. Pressurized air is directed axially rearward from the compressors 20, is mixed with fuel and ignited in the combustor 22 and is directed into the turbines 24 as high temperature combustion gases 25. The turbines 24 drive the compressors 20 through common shafts 26 supported by bearings 28. In the gas turbine engine shown, a high-pressure turbine 30 and a low-pressure turbine 32 receive the hot combustion gases 25 from the combustor 22.

Figure 2:
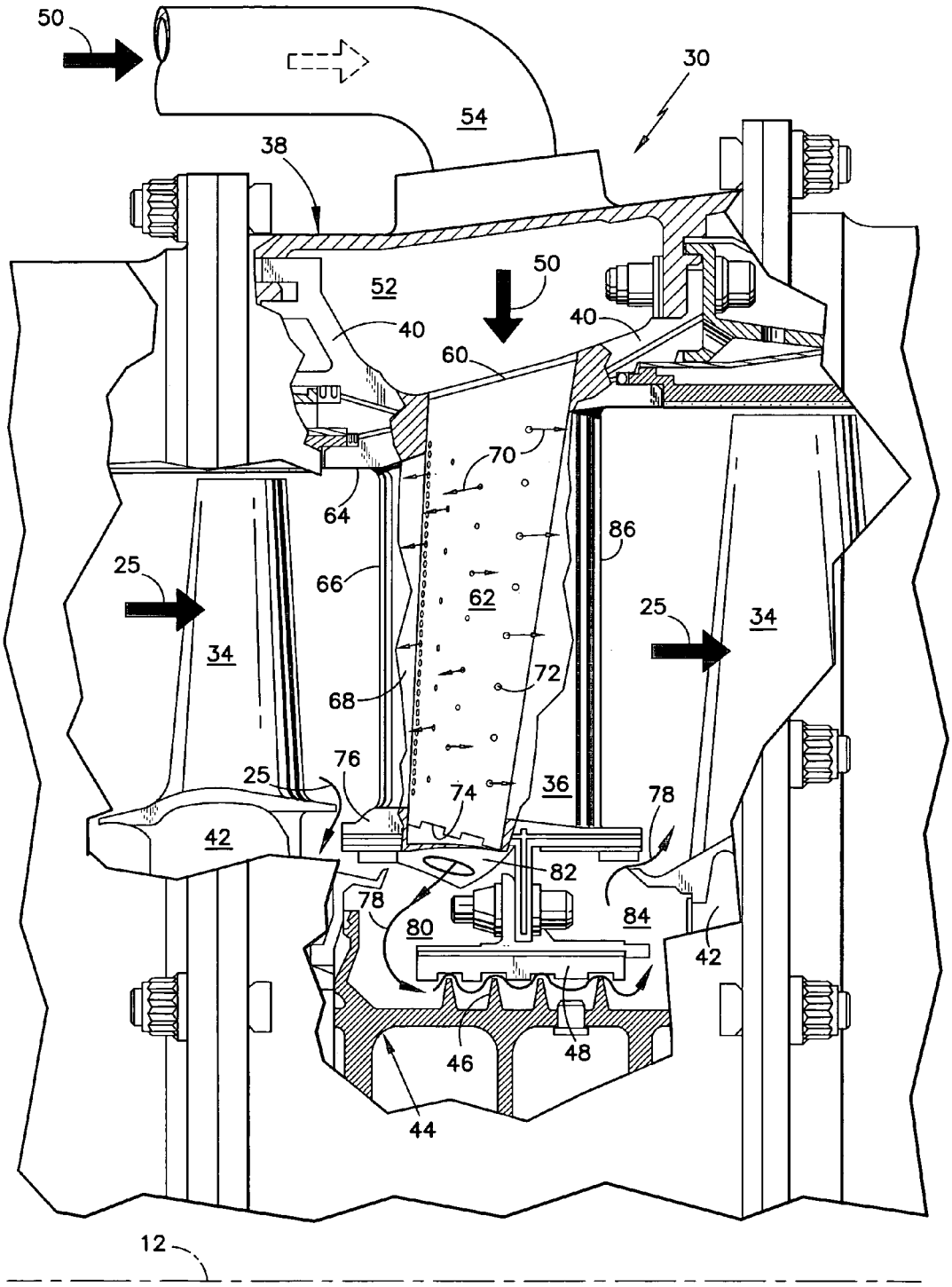
FIG. 2 is a partial sectional view of a turbine vane of the gas turbine engine of FIG. 1.

A high-pressure turbine 30, partially shown in more detail in FIG. 2, includes alternating axial stages of rotating blades 34 and stationary vanes 36 disposed within a case 38. The vanes 36 are cantilevered radially inward from the case 38 by flanges 40, while rotating disks 42 support the blades 34. A rotating spacer 44 and seal 46 are located radially inboard of the vane 36. The spacer 44 controls the axial spacing of the disks 42 and the seal 46 mates with a land 48, affixed to the stationary vanes 36. The seal 46 and land 48 discourage leakage of combustion gases 25 at the inner radial location of the vane 36 and are hereinafter referred to as the interstage seal 46 and land 48.

For protection against the hot combustion gases 25, the interstage seal 46 and land 48 must be convectively cooled. Since these crucial components are located radially inboard of the vanes 36, cooling air 50 must be directed through the vanes 36 and other components to reach them. First, the cooling air 50 is directed from the compressor 20 to an outer plenum 52 of a turbine case 38 by a distribution manifold 54. The outer plenum 52 then directs the cooling air 50 into perforated, tubular inserts 62 disposed within a hollow passage 68 of each vane 36. Each insert 62 apportions the cooling air 50 between the vane 36 and the interstage seal 46 and land 48. A first portion of the cooling air 50 is discharged as cooling air jets 70 through holes 72 in the insert 62 to cool the vane 36. The remaining portion of the cooling air 50 is discharged as seal and land cooling air 78 through a partially restricted second end 74 of the insert 62. The second end 74 of the insert 62 exits the vane 36 at a radially inner platform 76. The seal and land cooling air 78 is then directed into a forward inboard chamber 80 by an injector 82, and finally cools the interstage seal 46 and land 48. After cooling the interstage seal 46 and land 48, the cooling air 78 is directed through a rearward inboard chamber 84 and eventually mixes with the combustion gases 25 at a trailing edge 86 of the vane 36.

As the seal and land cooling air 78 passes through the vanes 36 and other components, its temperature increases and its cooling effectiveness is diminished. The inventive insert 62 distributes an increased volume of the seal and land cooling air 78, thus improving the durability and extending the life of the interstage seal 46 and land 48. Since the interstage seal 46 and land 48 is crucial to maintaining the overall efficiency and performance of the gas turbine engine, any improvement in durability is desirable.

Referring now to FIG. 3, an insert 62 comprises a tubular body 90, a first end 60 and a second end 74 located opposite the first end 60. The body 90 is made of a high-temperature, sheet material and accepts cooling air 50 via the first end 60. The body 90 may be made by die forming a flat sheet and seam welding along the longitudinal axis, extruding, pressure forming or by any other suitable method. The body 90 may approximate the shape of the hollow passage 68 to which it is disposed and, although a body with an airfoil shaped transverse cross section is shown in the examples, other shapes may be used. Multiple impingement holes 72 penetrate the body 90 and may be drilled using laser, punching, electrodischarge machining or any other suitable method. The impingement holes 72 discharge cooling air jets 70 against the hollow passages 68, thus removing a significant amount of heat from the vane 36.

A first end 60 as shown in FIG. 4, introduces cooling air 50 supplied by the plenum 52, into the body 90 of the insert 62. The first end 60 shown in the example matches the airfoil shape of the body 90 and includes a leading edge 92, a trailing edge 94, a concave face 96 and a convex face 98. The periphery of the first end 60 fits tightly within the hollow passage 68 of the vane 36 at the outer platform 64 to prevent leakage of the cooling air 50.

Several examples of a second end 74, for discharging the seal cooling air 78, are shown in FIGS. 5 through 8. In each of the examples, one or more tabs 104 extend radially from the body 90 and are distributed about the periphery of the second end 74. Alternating between tabs 104 are corresponding notches 106 in the body 90, which discharge the seal and land cooling air 78. One or more covers 108 may be joined to opposing tabs 104 by bridging across the second end 74, or opposing tabs 104 may be joined together by bridging (not shown) across the second end 74. The bridging covers 108 and tabs 104 provide a restriction to the incoming cooling air 50, thus increasing the velocity of the impingement-cooling jets 70. Also, the covers 108 and tabs 104 act as ligaments, preventing collapse of the outlet 74 during assembly and exposure to the extreme combustion gas temperatures. The tabs 104 may be manufactured by stamping prior to forming the body 90 or by any other suitable means. The covers 108 may be formed separately and affixed to the tabs 104 by welding, brazing or other suitable methods. Alternately, a single cover 108 may be affixed to the body 90 and the notches 106 may later be machined through the cover 108 and body 90 simultaneously. The notches 106 may be machined using wire electrodischarge machining (EDM), grinding, conventional machining or by any other suitable method.

Referring now to an embodiment of an insert of FIG. 5, a second end 74 comprises tabs 104 extending from the leading edge 92, trailing edge 94, concave face 96 and convex face 98 of the second end 60 periphery. It is noted that each of the leading 92 and trailing edge 94 tabs 104 also extend about a portion of the concave 96 and convex 98 faces. Alternating between tabs 104, are notches 106 for discharging the seal 46 and land 48 cooling air. Two covers 108 are joined to each tab 104 formed about the leading 92 and trailing edge 94, and a cover 108 bridges between the opposing tabs 104 at the concave 96 and convex face 98. Alternately, the tabs 104 themselves may be joined together by bridging across the second end 74 (not shown).

In an alternate example of a second end 74 of FIG. 6, the periphery of the second end 74 comprises a pair of tabs 104 on each of the concave 96 and convex 98 faces. Notches 106 in each of the concave face 96 and the convex face 98 discharge the seal 46 and land 48 cooling air. Two covers 108 are joined to opposing tabs 104 by bridging across the second end 74. Alternately, the tabs 104 themselves may be joined together by bridging across the second end 74 (not shown).

In yet another alternate example of FIG. 7, the periphery of the second end 74 comprises a tab 104 on each of the concave 96 and convex faces 98. A cover 108 is joined to the opposing tabs 104 by bridging across the second end 74. Alternately, the tabs 104 themselves may be joined together by bridging across the second end 74 (not shown).

In yet another alternate example of FIG. 8 the periphery of the second end 74 comprises a tab 104 on each of the leading 92 and trailing edges 94. It is noted that each of the leading 92 and trailing edge 94 tabs 104 also extend about a portion of the concave 96 and convex 98 faces. A cover 108 is joined to each of the tabs 104 by bridging across the second end 74. Alternately, the tabs 104 themselves may be joined together by bridging across the second end 74 (not shown).

In each of the examples described above, an inventive insert 62 distributes an increased volume of seal and land cooling air 78 without reducing the velocity of the impingement-cooling jets 70 or diminishing the structural integrity of the insert 62. Additionally, it has been shown that the inventive insert 62 is capable of being produced in a robust and repeatable manner, with existing manufacturing processes and tooling and at a reasonable cost.

While the present invention has been described in the context of specific embodiments thereof, other alternatives, modifications and variations will become apparent to those skilled in the art having read the foregoing description. Accordingly, it is intended to embrace those alternatives, modifications and variations as fall within the broad scope of the appended claims.

What is claimed is:

1. An airfoil insert for discharging cooling air, comprising:

a tubular body;

a first end for introducing cooling air into said body;

a second end, said second end being opposite said first end;

one or more tabs extending from said second end of said body, said tabs being spaced about a periphery of said second end; and one or more covers joined to one or more separate tabs with at least one of said one or more covers being joined by welding.

2. The insert of claim 1, wherein:

the airfoil is a turbine vane.

3. An airfoil insert for discharging cooling air, comprising:

a tubular body, said tubular body having an airfoil shaped transverse cross-section;

a first end for introducing cooling air into said body; a second end, said second end being opposite said first end, the periphery of said second end comprises a concave shaped region, a convex shaped region located opposite the concave shaped region, a forward directed leading edge region located between said convex and concave shaped regions and a rearward directed trailing edge region located opposite said leading edge region;

one or more tabs extending from said second end of said body, said tabs being spaced about a periphery of said second end, with a tab extending from said second end at each of said leading and trailing edge regions of the periphery; and one or more covers joined to said one or more tabs, said covers bridging said second end and defining one or more spaced apertures for discharging at least a portion of the introduced cooling air.

4. The insert of claim 3, wherein:

said tabs at said leading and trailing edge regions further extend about portions of said concave and convex shaped regions of the periphery.

5. The insert of claim 4, further comprising:

a cover joined to each of the tabs extending from the leading edge and trailing edge regions.

6. The insert of claim 5, wherein:

said covers are joined to each of the tabs by welding.

7. The insert of claim 6, wherein:

the airfoil is a turbine vane.

8. The insert of claim 5, wherein:

said covers are joined to each of the tabs by brazing.

9. The insert of claim 8, wherein:

the airfoil is a turbine vane.

10. An airfoil insert for discharging cooling air, comprising:

a tubular body, said body terminating at a first end for introducing cooling air and at a second end for discharging at least a portion of the cooling air;

one or more tabs spaced about a periphery of said second end; and wherein a first tab bridges said second end and connects to a second tab by welding, defining one or more spaced apertures for discharging the at least a portion of the introduced cooling air.

11. The insert of claim 10, wherein:

the airfoil is a turbine vane.

12. An airfoil insert for discharging cooling air, comprising:

a tubular body;

a first end for introducing cooling air into said body;

a second end, said second end being opposite said first end;

one or more tabs extending from said second end of said body, said tabs being spaced about a periphery of said second end; and one or more covers joined to one or more separate tabs with at least one of said one or more covers being joined by brazing.

13. The insert of claim 12 wherein:

the airfoil is a turbine vane.

14. An airfoil insert for discharging cooling air, comprising:

a tubular body, said body terminating at a first end for introducing cooling air and at a second end for discharging at least a portion of the cooling air;

one or more tabs spaced about a periphery of said second end; and wherein a first tab bridges said second end and connects to a second tab by brazing, defining one or more spaced apertures for discharging the at least a portion of the introduced cooling air.

15. The insert of claim 14, wherein:

the airfoil is a turbine vane.

* * * * *